US006305688B1

(12) United States Patent
Waroway

(10) Patent No.: US 6,305,688 B1
(45) Date of Patent: Oct. 23, 2001

(54) GEOMETRICALLY PATTERNED TILES AND GAME

(76) Inventor: Robert M. Waroway, 3471 Sego-Glen Cir., Las Vegas, NV (US) 89121

( * ) Notice: Subject to any disclaimer, the term of this patent is extended or adjusted under 35 U.S.C. 154(b) by 0 days.

(21) Appl. No.: 09/296,300

(22) Filed: Apr. 22, 1999

Related U.S. Application Data

(60) Provisional application No. 60/083,072, filed on Apr. 27, 1998.

(51) Int. Cl.[7] ..... A63F 3/00

(52) U.S. Cl. ..... 273/292; 273/275; 273/157 R

(58) Field of Search ..... 273/275, 156, 273/157 R, 292, FOR 225, FOR 153, FOR 157, FOR 292

(56) References Cited

U.S. PATENT DOCUMENTS

| | | | |
|---|---|---|---|
| 1,973,564 | * | 9/1934 | Graham . |
| 2,520,207 | | 8/1950 | Graham . |
| 2,571,195 | | 10/1951 | Buck . |
| 2,585,268 | | 2/1952 | Olsen . |
| 3,643,956 | | 2/1972 | Bovasso . |
| 4,180,271 | | 12/1979 | McMurchie . |
| 4,190,256 | | 2/1980 | Rudden, Jr. . |
| 4,436,309 | | 3/1984 | Barlow et al. . |
| 5,692,749 | * | 12/1997 | Vogeler . |

FOREIGN PATENT DOCUMENTS

| | | | |
|---|---|---|---|
| 1216453 | | 4/1960 | (FR) . |
| 2690650 | | 11/1993 | (FR) . |
| 627425 | * | 8/1949 | (GB) . |

OTHER PUBLICATIONS

Rules for playing Psyche–Paths, 1968.*

* cited by examiner

*Primary Examiner*—Benjamin H. Layno
*Assistant Examiner*—Vishu K. Mendiratta
(74) *Attorney, Agent, or Firm*—Richard C. Litman

(57) ABSTRACT

A set of geometrically patterned rectangular tiles includes a plurality of tiles each having a different pattern of arcuate segments thereon. The tiles may be used to form various interlocking and overlying circular, semicircular, and sinusoidal patterns or designs for various purposes, such as architectural and other designs. The tiles are also suited for the play of various games, with the object of the games being to form one or more continuous paths of joined arcuate segments enclosing other areas of assembled or adjacent tiles placed during the play of the games. Tiles may be divided generally into two groups, with one group having at least two different curved segments thereon, each differentiated from the other and with a single player or team controlling any one variation of the different segments, and another group having one or more different segments thereon for use as border or peripheral pieces for the first group. Where one or more segments meet a tile edge, the segment end or ends are symmetrically disposed along the tile edge so meeting segments exactly align with one another when tiles are placed adjacent to one another. In all cases, the arcuate or sinusoidal segments each have a finite width defining a path, rather than being merely a thin line. Thus, the finite widths of the segments may overlap one another, with the tiles being arranged to form paths which cross over one another accordingly during the arranging of the tiles during the course of a game.

17 Claims, 8 Drawing Sheets

GEOMETRICALLY PATTERNED TILES AND GAME

REFERENCE TO RELATED PATENT APPLICATION

This application claims the benefit of U.S. Provisional patent application Ser. No. 60/083,072, filed on Apr. 27, 1998.

BACKGROUND OF THE INVENTION

1. Field of the Invention

The present invention relates generally to games and devices having selectively interlocking patterns, and more specifically to a plurality of tiles or playing pieces each having a different semicircular geometric pattern thereon. The patterns of each of the tiles are configured to join smoothly with every other tile pattern, thereby enabling persons to form circular and sinusoidal geometric patterns using the tiles or pieces. The present tiles may be used in a game, with scoring according to the size and number of enclosed areas formed by each player, and/or may be used to form various decorative designs for architectural and other purposes.

2. Description of the Related Art

The human mind has developed innumerable geometric patterns in art and design since the beginnings of history. Such patterns have been applied in various ways, in games, structures, architectural design, containers, and various other articles throughout history. The development of such regular geometric designs has led to the further development of various puzzles and games which utilize mating portions of such patterns, which the players must assemble.

Most games and puzzles using such playing pieces also require a board or frame upon which the game is played or the puzzle assembled. Still others utilize irregularly shaped playing pieces, and/or irregular patterns or pictures, e. Eg., the classic jigsaw puzzle. While various games and puzzles utilizing a plurality of playing pieces to form various geometric shapes have been developed in the past, the present tiles and games developed using those tiles, provide a novel apparatus and method not previously disclosed. A discussion of the related art of which the present inventor is aware, and its differences and distinctions from the present invention, is provided below.

U.S. Pat. No. 2,520,207 issued on Aug. 29, 1950 to Mary K. Graham, titled "Game Board And Arcuate Playing Pieces," describes a game having a game board with a series of interlocking circular grooves formed therein. Playing pieces comprise a plurality of essentially quarter circular arcs, which are placed in the grooves of the game board. All of the arcuate pieces are identical to one another, as opposed to the different pieces of the present tile patterns, and no game board is necessary with the present tiles or pieces. The object of the Graham game is to close any area using four of the arcuate pieces. Any player doing so, receives one or more points depending upon the location of the closed area on the board. In contrast, the present tiles include two or more pattern portions on each tile or piece, which provide for a multitude of different games. Scoring is dependent upon the size of the area enclosed, or other rules according to the game.

U.S. Pat. No. 2,571,195 issued on Oct. 16, 1951 to Gordon F. Buck, titled "Set Of Game Pieces," describes a game in which two or more players (or teams) each attempt to arrange a plurality of patterned tiles to form a larger geometric pattern. Each player or team works independently in this effort, using their own pieces with no interaction with other players or teams, unlike the present tile game. If one player or team is able to complete an arrangement using all of their playing pieces, the game is over. If not, then the game progresses to a second stage where players interact, using one another's playing pieces in attempts to form geometric shapes. The initially independent play, subsequent interaction of players using one another's playing pieces, the need for a game board for at least some of the play, and geometric patterns of the playing pieces, are unlike any of the rules and apparatus of the present game.

U.S. Pat. No. 2,585,268 issued on Feb. 12, 1952 to Paul Olsen, titled "Game Board And Multiple Elements Therefor," describes a game in which tiles or pieces are placed upon the playing surface of the board in accordance with the rules of the game, to define a pattern thereover. Additional playing pieces are provided, which may only move along and over the first tiles which have been placed on the board. In contrast, the present tiles when used in a game, do not require a game board; do not include any other types of playing pieces; and serve as the game playing pieces themselves, by surrounding areas and forming various arcuate geometric shapes with scores being awarded accordingly.

U.S. Pat. No. 3,643,956 issued on Feb. 22, 1972 to Bernard X. Bovasso, titled "Board Game Apparatus," describes a game having a plurality of square tiles or pieces, each having one or more rectilinear, diagonal, or arcuate playing path segments formed thereacross. The object of the game is to use one's markers to form a continuous path across the board by means of the connected path segments on the markers, or to form a completely enclosed area using the path segments. Bovasso does not provide differently colored or patterned path segments on his playing pieces, however; all of the playing path segments on each of the pieces are identically marked. This is a critical point, as markers placed by opposing players may blend to form a single continuous playing path, with no discernible difference between the path of one player and the path of another. The present game avoids this problem by providing at least two differently colored or marked segments in each set of the playing pieces, so that each player is responsible for developing a single, distinct path using his or her tiles. Also, the differently marked path segments of the present tiles allow paths developed by opposing players to overlap one another as the game develops, unlike the Bovasso game. In addition, it should be noted that Bovasso requires a game board for the play of his game, while the present tiles do not require any form of game board or boundary; rather, the development of the tiles during the course of a game is completely free form in the present tile game invention. Also, the arcuate segments of the present tiles are related, in that each segment has an identical configuration to its symmetrically opposite member of each tile (i. e., same radius and width). This is not true with the Bovasso tile patterns. This results in a lack of any overlay of one segment with another in the Bovasso tiles, whereas where two or more arcuate segments are provided on a single tile of the present invention, one of the segments will appear to overlay another.

U.S. Pat. No. 4,180,271 issued on Dec. 25, 1979 to Thomas McMurchie, titled "Squiggle Game," describes a game having a game board providing for the placement of a series of square or rectangular playing pieces thereon. Each of the pieces contains at least two segments of playing paths thereon. The object of the game is to create a continuous playing path beginning at one edge of the board, and continuing across and about the board for as long as possible. The playing pieces differ from those of the present invention in that the McMurchie pieces do not differentiate between path segments; i. e., each of the segments comprises a thin line of the same color, etc. as every other segment. The different paths being formed by each player are identified by a different marker piece for each player, with each player placing his/her marker at the end of their respective partially completed playing path as the game progresses. In contrast, the plural arcuate segments of the present tiles are each differently marked or configured in some way from one another; i. e., one group of segments may be of a different color than the other group, or a different finite width, or have a different style of border, etc. In this way, each player can easily identify his or her path being formed during the course of a game. Also, the object of at least one of the games which may be played with the present tiles is different, in that it seeks to enclose areas by means of forming a continuous path, rather than being limited to a specific game board size and configuration, as in the McMurchie game. The game played using the present tiles, does not include a board and is not limited to any particular area.

U.S. Pat. No. 4,190,256 issued on Feb. 26, 1980 to Thomas J. Rudden, Jr., titled "Path Forming Game," describes a game having a board surface formed of a series of contiguous regular hexagons, with a plurality of regular hexagonal playing pieces being provided to each player. Each of the pieces is marked to form a continuous or broken portion of a playing path thereacross. The object is for each player to form a continuous path across the board using his or her playing pieces, while simultaneously blocking the progress of other players. The playing path portions of each piece all have identical appearances, with no difference in color, texture, etc. being provided, unlike the differently colored or configured segments of the present tiles or pieces. Thus, the Rudden, Jr. pieces of one player may be used in combination with the pieces of an opposing player to form a single continuous path, unlike games played with the present pieces. Also, Rudden, Jr. does not disclose any plurality of arcuate shapes on his playing pieces, as provided with the present tiles or pieces.

U.S. Pat. No. 4,436,309 issued on Mar. 13, 1984 to Gordon A. Barlow et al., titled "Strategy Card Game," describes a game having a game board with a plurality of square playing pieces, each divided into a three by three matrix of nine squares of two or more different colors or patterns. The object of the game is to form at least one pattern of a three by three matrix of nine squares all of the same color or pattern, by overlapping the playing pieces as required. No path portions on the playing pieces, or means of forming paths across the board, is disclosed by Barlow et al.

U.S. Pat. No. 5,692,749 issued on Dec. 2, 1997 to Roger Vogeler, titled "Matching Puzzle With Multiple Solutions," describes a puzzle having a series of square pieces each having a distinctive two color pattern thereon. The object of the puzzle is to assemble the pieces to form at least one continuous pattern disposed over the entire group of assembled pieces. Vogeler describes the specific peripheral configuration of each piece, i.e., with the juncture between colors being at one fourth of the distance along a given side of the piece. The present tiles or pieces are specifically configured, but each segment or group of segments along any given edge forms a symmetrically disposed pattern along that edge. Also, Vogeler does not disclose any means of playing a competitive game with his puzzle, whereas the present tiles or pieces may be used to play various games.

French Patent Publication No. 1,246,453 published on Apr. 26, 1960 illustrates a plurality of square pieces which may be used in a puzzle or the like. Each of the pieces includes two or more path segments thereacross, with the segments apparently being symmetrically disposed at each edge of each square piece. However, the segments themselves are not symmetrical, as is the case with all of the tiles of the present invention having a complete pattern of two different path segments disposed thereon. The pieces of the French Patent Publication cannot be used to form any type of repeating, symmetrical pattern, as can the present tiles. No means of playing a game using the pieces of the French Patent Publication, is apparent.

Finally, French Patent Publication No. 2,690,650 published on Nov. 5, 1993 illustrates a series of three different geometric shapes, comprising two different sizes of squares and a parallelogram. The sides of the various shapes are dimensioned to provide a congruent pattern when various numbers and arrangements of the pieces are assembled together. No means of forming one or more continuous paths about or across the pattern, nor for providing a competitive game, is disclosed.

None of the above inventions and patents, taken either singly or in combination, is seen to describe the instant invention as claimed.

SUMMARY OF THE INVENTION

The present invention comprises geometrically patterned tiles and a game played therewith, including a plurality of differently patterned tiles or pieces. Each of the tiles includes one or more arcuate segments thereon, with plural segments disposed on a single tile each being differentiated from one another in some way. The arcuate segments are each symmetrically positioned where they meet an edge of a tile, so that the tiles may be placed edge to edge with the arcuate segments mating precisely to form an arcuate path over a series of mutually adjacent tiles. The tiles may be used to form various geometric patterns and free form designs, and/or may be used in the play of various embodiments of games, with the object in at least one of the games being to enclose one or more areas by means of a continuous arcuate path. No separate game board or other apparatus is required for the play of games using the present tiles.

Accordingly, it is a principal object of the invention to provide an improved geometrically patterned tile game comprising a plurality of tiles or pieces, each of which includes at least one arcuate path segment thereon, with no requirement for a game board.

It is another object of the invention to provide an improved tile game which path segments on each of the tiles are disposed symmetrically at each terminating edge of each path segment, whereby each path segment mates precisely with another path segment of an adjacent tile when tiles are matched edge to edge.

It is a further object of the invention to provide an improved tile game in which the path segments of tiles containing plural path segments, are differently colored or patterned from one another to distinguish path segments of one player from another.

An additional object of the invention is to provide an improved tile game in which the path segments of tiles containing plural path segments, each define a finite width and overlap one another as required to indicate plural continuous pathways.

Still another object of the invention is to provide an improved tile structure in which the tiles may be used to form geometric patterns for various decorative purposes as desired.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of rectangular tiles which may be used in the play of various games wherein players attempt to form circular or sinusoidal patterns using the shapes formed on the tiles, and/or which may be used to form various circular and/or sinusoidal shapes which may be used in architectural and/or other structural elements. Each of the tile embodiments may be considered to include two groups. Tiles of the first group of each embodiment have plural arcuate segments which extend to all four edges of each of the tiles, with such tiles being used to form the central areas of various patterns. Tiles of the second group of each embodiment have one or more arcuate segments which extend to two or three of the edges of each of the tiles, and are used as peripheral or border tiles about an assembly of the first group of tiles.

Figure 1:
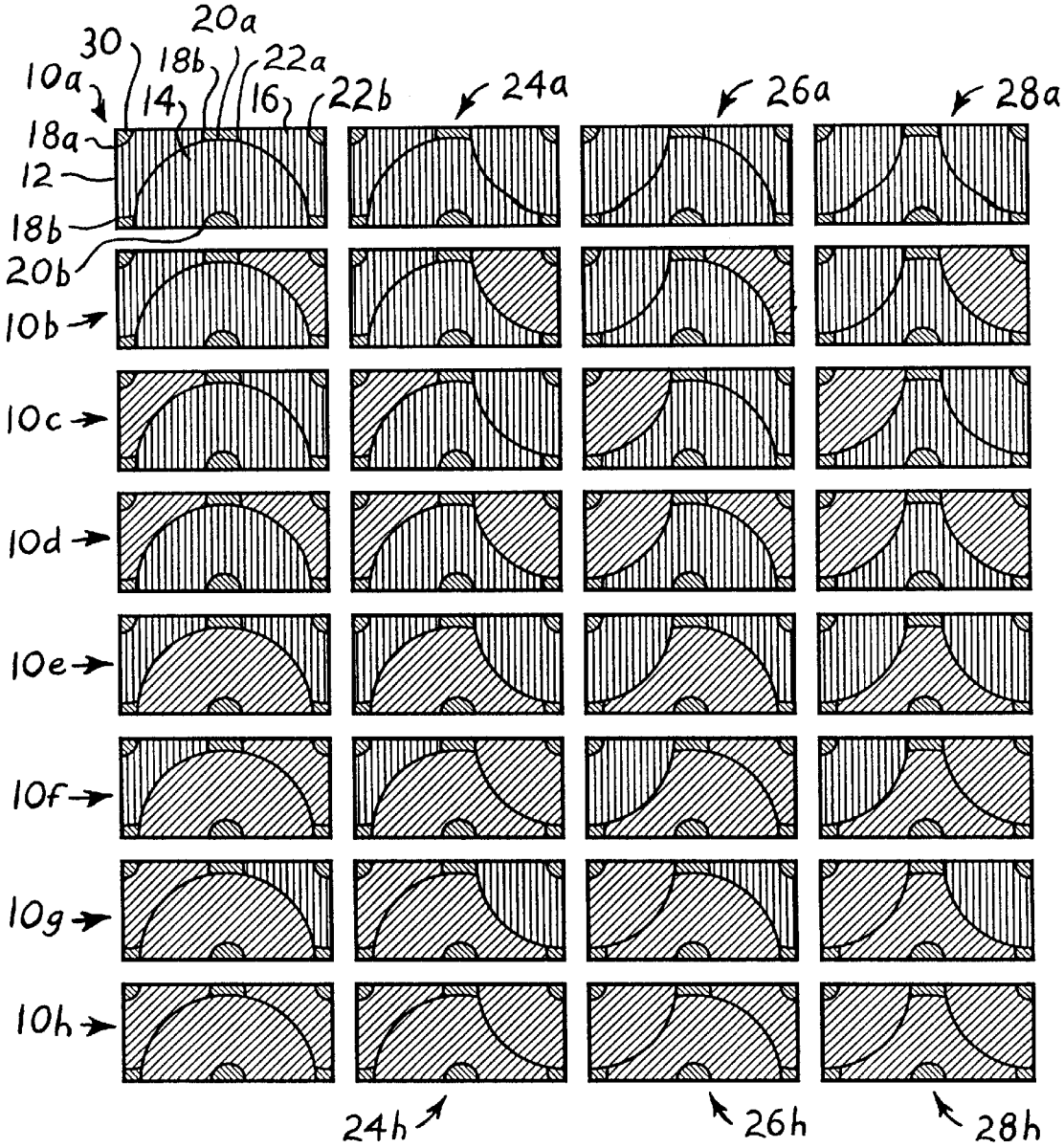
FIG. 1 is a plan view of a first group of tiles or pieces each having a different arrangement of three differently configured arcuate segments thereon.

FIG. 1 provides a plan view of all of the different patterns of first embodiment tiles of the first group according to the present invention. Each of these tiles or pieces includes portions or segments of three different arcuate segment areas therein. These segment areas may be differentiated from one another by border, color, texture, pattern shading, or in some other way, as desired, so long as a first segment is clearly separated from a second segment, and a third segment is clearly separated from the first and second segments. Accordingly, it will be seen that a large series of different patterns may be formed by different arrangements of the present tiles.

In the upper left tile 10*a* of FIG. 1, it will be seen that a first or leftmost quarter arcuate segment area 12 is partially concealed beneath a second semicircular segment area 14, which also overlaps a rightmost third quarter arcuate segment area 16. While these three segment areas are each of the same color or pattern, as indicated by the vertical shading lines of each of the segments 12 through 16, it will be seen that they are clearly separated by means of their relatively wide width and the contrasting narrow or thin borders, respectively first inner and outer borders 18*a* and 18*b* for the first segment 12, second inner and outer borders 20*a* and 20*b* for the second segment 14, and third inner and outer borders 22*a* and 22*b* respectively disposed along each edge of each segment 12 through 16.

In the tiles or pieces 10*b* through 10*h* directly below the upper left tile 10*a*, it will be seen that the second arcuate segment area in each of these tiles also overlaps the first and third segment areas, just as in the case of the segment areas 12 through 16 of the tile 10*a*. However, a different shading or pattern arrangement is provided in each of the tiles 10*b* through 10*h*, in order to distinguish the tiles 10*a* through 10*h* from one another. In the case of the tile 10*b*, the left and center arcuate segments each have a first shade or color, as in all three of the segments 12 through 16 of the first tile 10*a*, but the third or right hand segment of the second tile 10*b* is shaded differently than the first two segments of that tile 10*b*, having a second color or shade disposed thereon for contrast from the first two segments.

In the case of the third tile 10*c*, the second and third arcuate segment areas each include the first shading or coloring, designated by the vertical shading lines, while the third segment area is shaded using the second pattern, designated by the diagonal shading pattern extending from lower left to upper right in the third segment. In the fourth tile 10*d*, the first and third segments are shaded with the second shading, while the central second segment has the first color or shading. The fifth tile 10*e* colors the first and third segments with the first color or shading, designated by the vertical shading lines, with the central semicircular second segment being shaded using the second shading pattern. Tile 10*f* shades the first segment using the first shading pattern, and the second and third segments with the second pattern. Tile 10*g* shades the third segment using the first shading pattern, and the first and second segments with the second pattern. Finally, the last tile 10*h* in the first tile column of FIG. 1 shades all three segments using the second diagonal shading pattern.

The above shading pattern combinations, comprising two different colors, patterns, textures, etc. applied to three different areas, will be seen to provide a total of $2^3$ differently patterned tiles, or a total of eight different tiles. However, the tiles 10*a* through 10*h* comprise only those tiles in which the second, semicircular arcuate segment area overlaps the left, or first, and right, or second, segment areas. These same color, texture, or shading variations may be applied to other tiles having different arrangements of overlapping segments, as described below.

The tiles or pieces of the second column, designated as tiles 24*a* through 24*h*, also include three different arcuate segment areas, in the same manner as the eight tiles 10*a* through 10*h* of the first column of tiles in FIG. 1. However, it will be noted that in the second column, the third or rightmost arcuate segment area overlaps the right side of the second or central semicircular area, rather than underlying that area, as in the tiles 10*a* through 10*h* of the first column. The color, shading, or pattern arrangements of the arcuate segments of the tiles 24*a* through 24*h* of the second tile column, correspond exactly to those arrangements of the tiles 10*a* through 10*h* of the first column of tiles, e. g., all three segments of the tile 24*a* are colored or shaded with the first shading arrangement of vertical lines, all three segments of the last tile 24*h* are colored or shaded with the second shading arrangement of diagonal lines, etc.

The tiles of the third and fourth columns, respectively tiles 26*a* through 26*h* and 28*a* through 28*h*, each also include three different arcuate segment areas, in the manner of the tiles 10*a* through 10*h* and 24*a* through 24*h* of the first and second columns. The shading, coloring, or texturing of the arcuate segment areas has the same arrangement between any of the tiles in a given horizontal row, e. g, tiles 10*a*, 24*a*, 26*a*, and 28*a*, in which each of the segments in any given tile are all colored or shaded identically using a first shade. However, it will be seen that the overlapping arrangement of the segments is different in the tiles of the third and fourth columns, with the first segment of the third column tiles 26*a* through 26*h* overlapping the second segment of those tiles, and the second segment overlapping the third segment. In the fourth column tiles 28*a* through 28*h*, both the first and third segments overlap the central semicircular second segment area. Each of the tiles 10*a* through 28*h* includes a common background color, shading, or texture 30. It will be seen that there are two possible positions for the first segment relative to the second segment in each of the tiles 10*a* through 28*h*, i. e., overlying or underlying, and also two possible positions for the third segment relative to the second segment. Thus, there are $2^2$ or four possible different combinations of overlying or underlying relationships for the three overlapping segments in each of the tiles 10*a* through 28*h*. These four combinations, multiplied by the eight different color or shading combinations indicated in the tiles a through h of each of the columns, result in a total of thirty two different tiles which may be formed using the two color or shading variations for one or more of the segments, and the four possible overlying or underlying segment relationships. FIG. 1 illustrates each of these thirty two different possibilities. It will be seen that additional variations may be formed if a third color or shading were used to shade one or more of the three arcuate segment areas of the tiles 10*a* through 28*h*, if desired.

This combination of two quarter circular arcuate segments, and a single semicircular arcuate segment in each of the tiles 10*a* through 28*h*, results in at least one end of each segment extending to one of the four sides of each tile. In the tile 10*a*, the two ends of the first quarter circle segment 12 extend to the left and upper sides of the tile, while the two ends of the third segment 16 extend to the right and upper sides of the tile. Both ends of the central, second or semicircular segment 14 extend to the lower edge of the tile 10*a*. The arrangement of other tiles 10*b* through 28*h* is the same, with at least one end of one of the segments extending to at least one of the four edges of each tile. This arrangement works well when the tiles 10*a* through 28*h* are used to form a continuous pattern with no regard for a border or peripheral area, but the appearance of the segmented areas extending to each edge of each of the tiles results in an unfinished appearance for any pattern formed using the tiles 10*a* through 28*h*.

Figure 2:
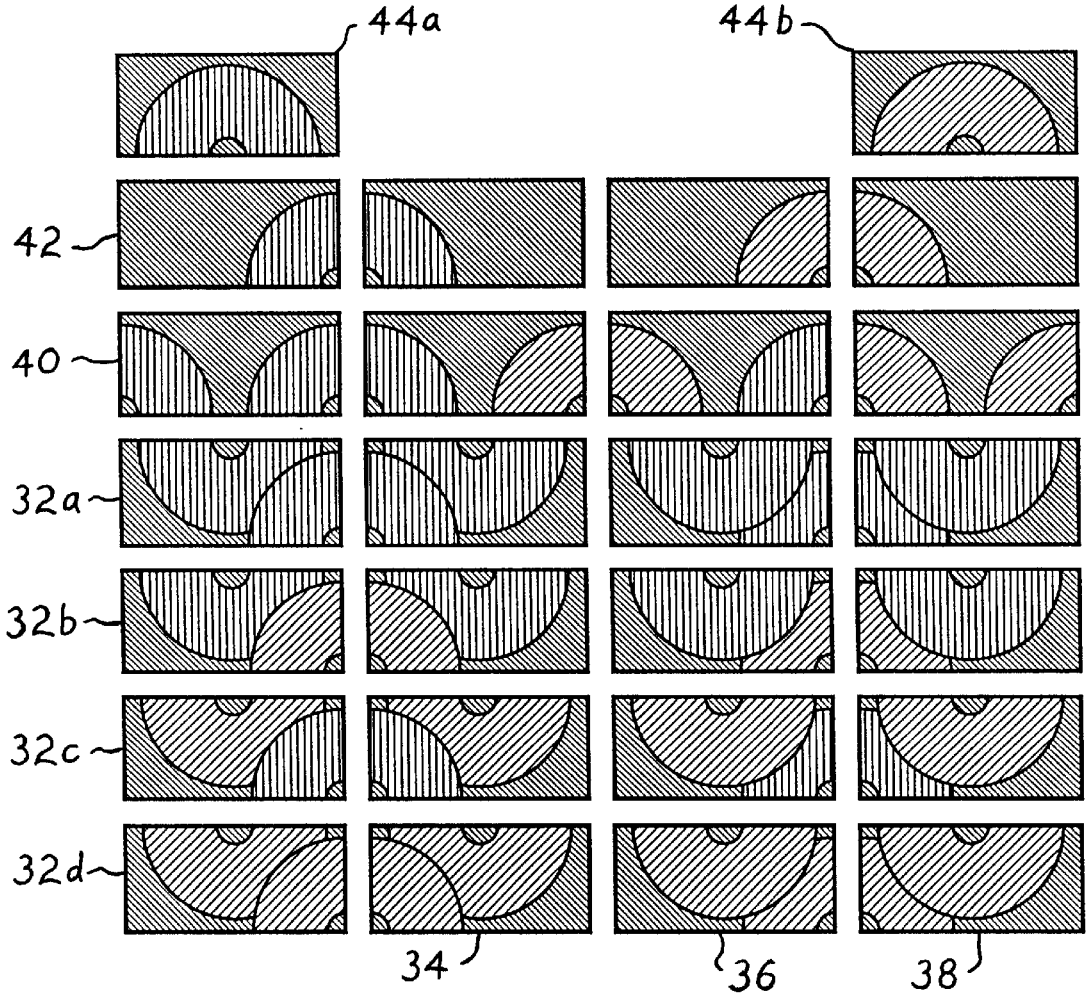
FIG. 2 is a plan view of a second group of tiles or pieces to be used with the first tile group for borders and edges thereabout, with each tile of the second group having a different arrangement of one or more differently configured arcuate segments.

Accordingly, FIG. 2 illustrates a second group of tiles used as border or peripheral tiles for the first group of tiles of FIG. 1. The tiles of FIG. 2 each have one or two arcuate segment areas therein, with a first set of tiles, designated as tiles 32*a* through 32*d*, each having a second semicircular arcuate area therein with a first quarter circular arcuate area partially overlying the second arcuate area, similar to the tiles 26*a* and 28*a* of FIG. 1. (It will be noted that the tiles 32*a* through 32*d* are inverted relative to the tiles 26*a* and 26*d* of FIG. 1, but the relationship of the arcuate segments remains essentially the same.)

It will be noted that the arcuate segments of the tiles 32*a* through 32*d* have different color or pattern combinations in each of those tiles. Tile 32*a* uses a single color or pattern for both of the segments, similar to the single color or pattern of the three segments of the tile 26*a* of FIG. 1. Tile 32*b* uses a second color or pattern for the quarter segment, while tile 32*c* uses the second color or pattern on the semicircular second segment. Tile 32*d* uses a second color, shade, or pattern for both segments of the tile.

The lowermost four tiles of the second row 34 of FIG. 2 are colored or shaded in an equivalent manner to the four tiles 32*a* through 32*d*, but the quarter circular section area is disposed to the left, rather than to the right. These four lower tiles of the second row 34 of FIG. 2 are somewhat analogous to tile 24*a* and the three tiles immediately therebelow in FIG. 1, but are inverted relative thereto, as in the case of the four tiles 32*a* through 32*d* discussed above, and lack the third quarter circular segment area elements. The color, shading, or patterns of those four lowermost tiles of the row 34 correspond to the tiles 32*a* through 32*d* of the first row.

The lowermost four tiles of the third and fourth rows 36 and 38 each differ from one another in a like manner to the four lowermost tiles 32*a* through 32*d* and the second row 34 of FIG. 2. It will be seen that the four lowermost tiles of the third and fourth rows are arranged and colored or shaded the same as the respective tiles 32*a* through 32*d* and the four lower tiles of the second row 34, but the quarter segment of each of those tiles underlies the semicircular arcuate segment, rather than overlying it, as in the tiles 32*a* through 32*d* and the four lowermost tiles of the second row 34. Thus, there are four different color or shading combinations for four different arcuate segment arrangements (left or right quarter segment, either overlying or underlying the semicircular segment), or sixteen different tile combinations including a single quarter circular segment and a semicircular segment. Each of these tiles includes one end (either left or right, depending upon the orientation of the quarter circular element) which is free of any such semicircular elements, and thus serves as a border or peripheral tile or piece for the tiles or pieces of FIG. 1.

FIG. 2 includes further border tiles including only the two quarter circular elements described as the first and third elements of the tiles of FIG. 1. As these elements do not overlap in the tiles of the second horizontal row 40 of FIG. 2, the only combinations possible are different colors or shades. With two possible colors or shades, and two separate elements, a total of $2^2$ or four different tiles is provided. In the case of the tiles of the second row 40, each of the quarter circular elements meets one of the opposite edges and a common edge, leaving the edge opposite the common edge open or clear to form a border or periphery free of any semicircular elements when one of these tiles is assembled with a group of tiles from FIG. 1.

The uppermost complete row 42 of FIG. 2 illustrates further tile combinations, with each of these tiles having only a single quarter circular element therein. As these quarter circular elements or segment areas cannot overlap one another, the only possible tile combinations are formed by means of the two different colors, shades, or patterns, and the left or right side placement of the single quarter circular element of each tile of the row 42. Accordingly, $2^2$ or four different tiles are possible.

Finally, one last variation on the tiles of FIGS. 1 and 2 is shown by the two rectangular tiles 44*a* and 44*b* at the top of FIG. 2. These two tiles each include only a single semicircular segment area, contacting only a single edge. Thus, the only variation is the color or shading between the two, as shown, with the semicircular segment of the tile 44*a* being shaded differently than the semicircular segment of the tile 44*b*. (Again, the semicircular segments of all of the tiles of FIG. 2 are shown inverted relative to the semicircular segments of the tiles of FIG. 1, but the relative orientation does not affect the number of different variations due to segment color, number of segments in various tiles, and relative underlying or overlying of various segments.)

When all of the different possible variations of the first group of thirty two tiles of FIG. 1 and the second group of twenty six tiles of FIG. 2 are added together, it will be seen that the various combinations of elements and colors or shades provide a total of fifty eight different tile configurations, all of which are shown in FIGS. 1 and 2.

Figure 3:
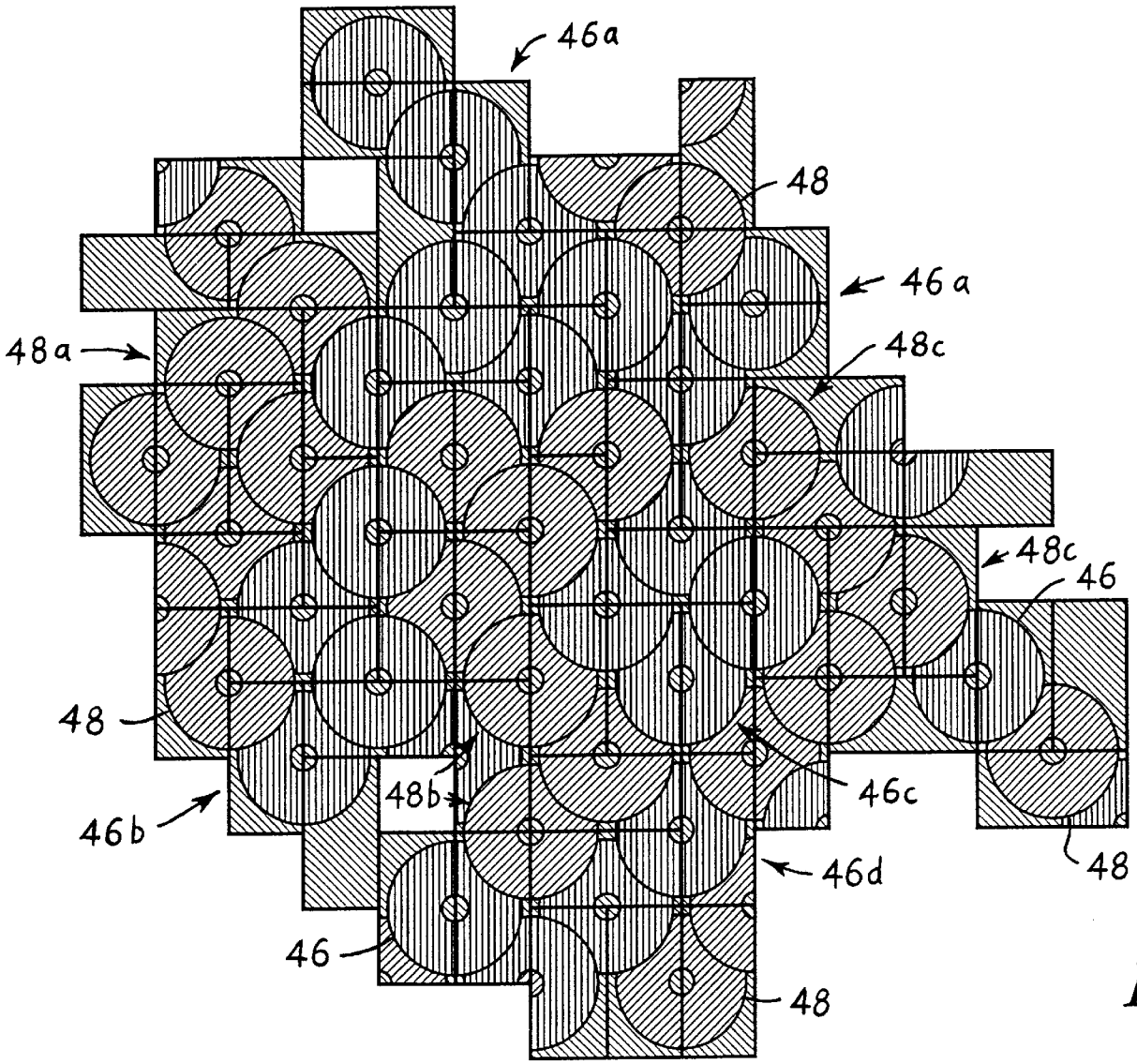
FIG. 3 is a plan view of one possible tile arrangement in a game using the tiles of FIGS. 1 and 2.

The tiles shown in FIGS. 1, 2, and 3 are each rectangular in shape and have a length twice their width, with the first group tiles of FIG. 1 each having three arcuate segment areas disposed therein. However, it should be noted that any of the above described tiles could be divided in half to form a series of square tiles numbering twice that of the tiles shown in FIGS. 1 and 2, or a total of one hundred and sixteen tiles. (A somewhat lower number of such square tiles would complete a square tile set where no duplication existed.) Such square tiles would each contain at most only two arcuate segment areas, rather than the three arcuate segment areas of the first group of tiles of FIG. 1. The same principles apply insofar as overlapping and underlying arcuate segments, and different colors, shades, or patterns providing for different combinations of such tiles.

The above described tile set of FIGS. 1 and 2 may be used to form various architectural designs comprising series of overlapping and underlying circular elements, and/or may be used in a game involving the alternating placement of tile elements while attempting to create circular areas surrounding other circular areas of an opposing player. FIG. 3 illustrates an exemplary tile arrangement which might occur during the play of a game using the tiles of FIGS. 1 and 2. An exemplary game using the first and second group tiles of FIGS. 1 and 2 is played by initially selecting or determining a first and a second player or team (e.g., by drawing a predetermined type of tile, or by conventional means, such as a coin or die toss, card cut, etc.).

The tiles are then randomly distributed among two players or two teams, according to the number of persons involved in the game. As only two different overlapping segments are provided in the tiles of FIGS. 1 and 2, according to the two different colors, shades, or patterns used to distinguish the segment areas from one another, a maximum of only two different players or teams may play using such tiles, with each player or team assigned a different color, shade, or pattern. However, other embodiments (one of which is discussed further below) may provide additional differentiation between segment areas, and allow for more players or teams.

A first player or team selects one of the tiles of the first group (i. e., a tile having segment ends extending to all four sides or edges of the tile, rather than a border tile of the second group) and plays that tile on any suitable surface (table top, desk, etc.). It should be noted that no game board is required or desired for the play of the present tile game. The opposing second player or team then plays a tile from his/her/their set, so that like colored, shaded, or patterned arcuate segments meet with one another when the two tiles are placed edge to edge. (The tiles for each player or team may initially be placed face down for further challenge to players, with each player or team being required to find a matching position for their randomly selected tile on each play.) Players or teams continue to alternate play, attempting to form continuous arcuate paths or closed loops (or in the case of the tiles of the first and second groups of FIGS. 1 and 2, a series of overlapping circles) as they play.

When all tiles of the first group (or "full" tiles, i. e., having arcuate segment ends extending to each of the four sides of the rectangular tiles) have been played, the "border" tiles, or tiles having one or more edges without a segment end extending thereto, are played, with players still attempting to complete as many closed areas or circles as possible. When all tiles have been played (or as many as have a matching position on the arrangement), the scoring is determined. Scoring may be accomplished by merely adding up the number of complete circles of each of the contrasting colors, shades, or patterns; this may be preferable in a game for smaller children. However, additional interest may be provided by increasing the score according to the square of the number of contiguous or overlapping circular areas formed by each team. This encourages each player or team to play to form contiguous patterns, rather than forming individual circles. It also encourages the enclosure of other areas, thereby restricting the ability of the opposition to form large contiguous areas.

In the example of FIG. 3, the tiles have been used to form a first plurality of complete, closed circles 46 of the first player or team (indicated by vertically oriented shading lines in each of the circles) and a second plurality of closed circles 48 of the second player or team (indicated by diagonal shading lines extending upwardly and to the right in each of the completed circles). A total of four different groups of plural contiguous circles 46 have been formed, designated as groups 46*a* through 46*d* in FIG. 3, with another two individual circles 46 having also been formed. The opposing circles 48 comprise a total of three groups of plural circles, designated as groups 48*a* through 48*c*, with four complete individual circles 48 also having been formed. (Incomplete circles, or incomplete circles between two like groups, do not count.) Scoring may be accomplished as follows:

FIRST PLAYER OR TEAM SCORE

First group 46*a*=9 complete, overlapping circles=$9^2$=81 points

Second group 46*b*=4 complete, overlapping circles=$4^2$=16 points

Third group 46*c*=4 complete, overlapping circles=$4^2$=16 points

Fourth group 46*d*=2 complete, overlapping circles=$2^2$=4 points

Plus two individual complete circles, at one point each =2 points

TOTAL FOR FIRST PLAYER OR TEAM CIRCLES=119 POINTS

SECOND PLAYER OR TEAM SCORE

First group 48*a*=6 complete, overlapping circles=$6^2$=36 points

Second group 48*b*=7 complete, overlapping circles=$7^2$=49 points

Third group 48*c*=5 complete, overlapping circles=$5^2$=25 points

Plus four individual complete circles, at one point each=4 points

TOTAL FOR SECOND PLAYER OR TEAM CIRCLES= 114 POINTS

As noted further above, other scoring systems may be used, in which each individual circle is counted as one point, for simplification. However, the squaring of group numbers provides incentive to build upon existing circles and block opponent's circle groups, thereby increasing the strategy of the game.

Figure 4:
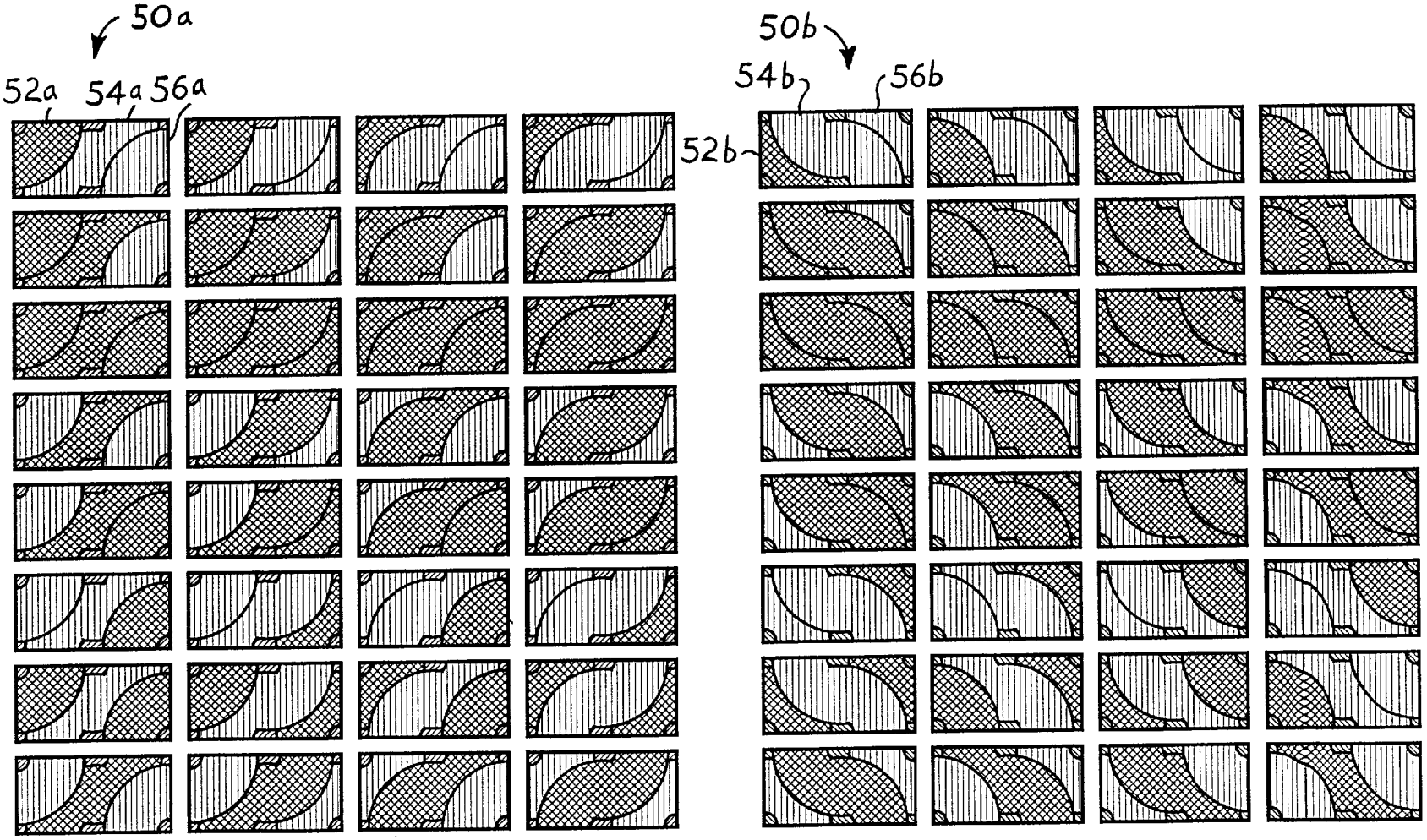
FIG. 4 is a plan view of a first group of second embodiment tiles, each having a different arrangement of three differently configured arcuate or sinusoidal segments thereon.
Figure 5:
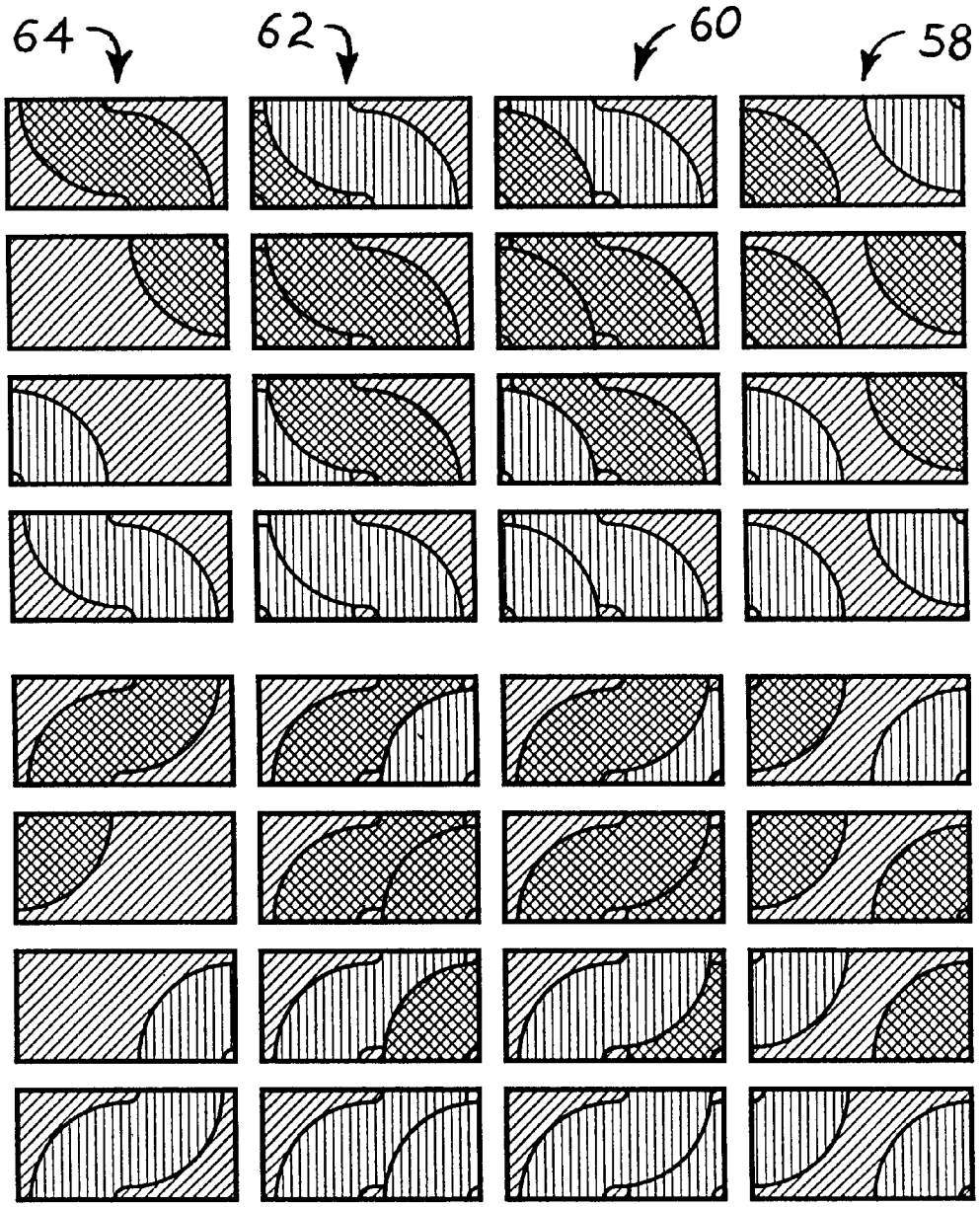
FIG. 5 is a plan view of a second group of second embodiment tiles or pieces to be used with the first tile group for borders and edges thereabout, with each tile of the second group having a different arrangement of one or more differently configured arcuate or sinusoidal segments.
Figure 6:
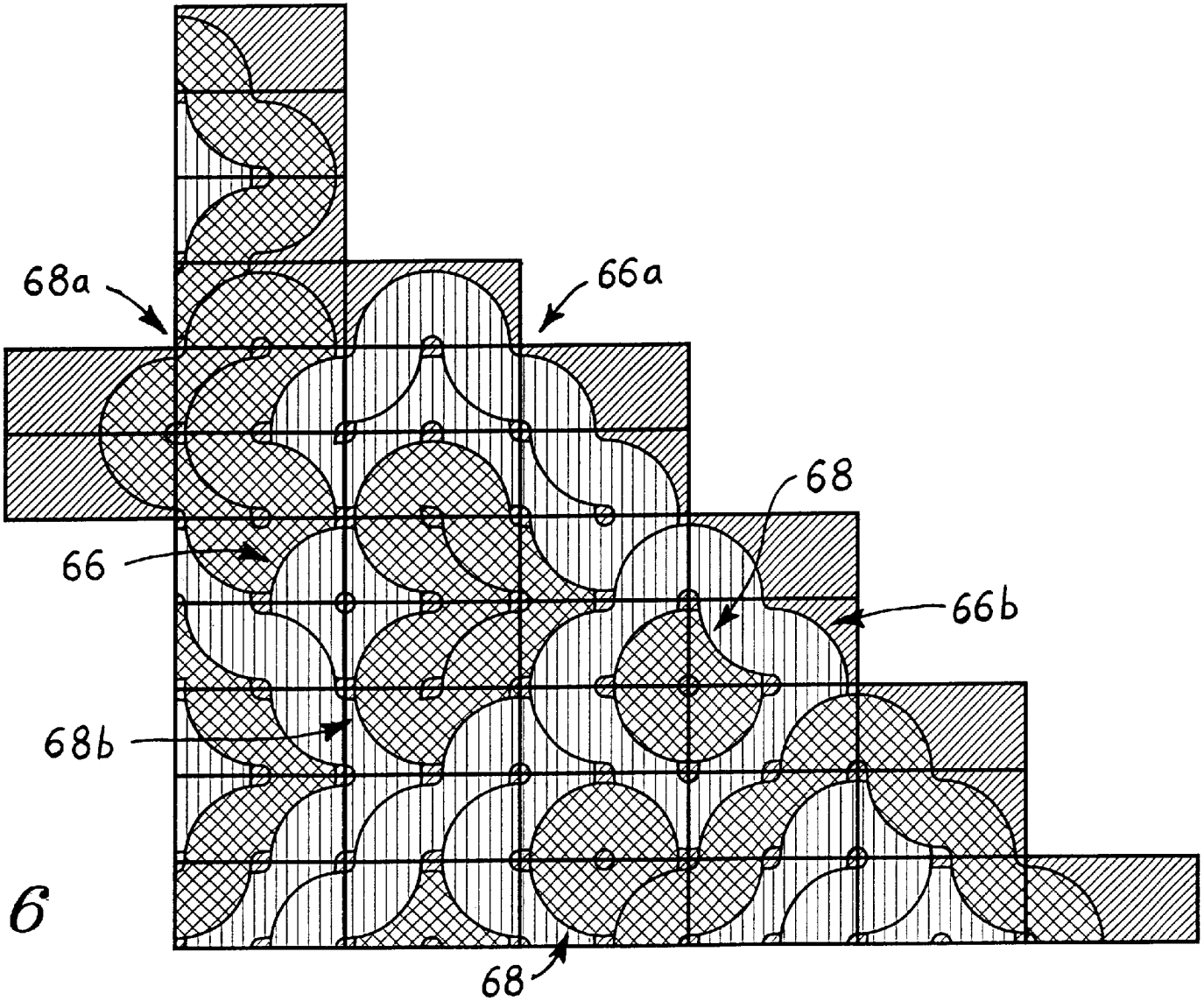
FIG. 6 is a plan view of one possible tile arrangement in a game using the tiles of FIGS. 4 and 5.

FIGS. 4 through 6 disclose an alternative embodiment of the present tile invention, wherein at least all of the "full" tiles, i. e., those having arcuate segments extending to each of their four edges, each include a sinusoidal element. It will be seen that such tiles may be formed from relatively inverted square halves of the rectangular first group tiles of FIG. 1. Once again, only two colors, shades, or patterns are used to distinguish the two different arcuate or sinusoidal segments used in the tiles of FIGS. 4 through 6, with a common background color, shade, or pattern, but it will be seen that additional colors, etc. could be used to provide three differently characterized segments, if desired, with the number of possible configurations increasing as increasing numbers of different colors, shades, or patterns are used to provide different segments.

The individual tiles of the first group of FIG. 4 are formed somewhat similarly to the tiles of FIGS. 1 through 3, with a first group or "full" tile 50*a* in the upper left corner of FIG. 4 being used as an exemplary model. The tile 50*a* includes a first or leftmost arcuate segment 52*a*, a second or central sinusoidal segment 54*a*, and a third or rightmost arcuate segment 56*a*, somewhat similar to the first through third segments 12 through 16 of the tiles of FIG. 1. However, the central or second arcuate segment areas 54*a* of the tiles of FIG. 4 are sinusoidally shaped to extend to opposite edges of each tile, rather than forming a semicircular shape with both ends extending to a single common edge of the respective tile, as in the tiles of FIG. 1.

The two different colors, textures, or shades of the three arcuate segment areas 52*a* through 56*a* of each of the tiles of FIG. 4, in combination with the various combinations of overlapping and underlying edges between the three arcuate areas, will be seen to form a large number of different possible variations, all of which are shown in FIG. 4. Also, it will be noted that the central sinusoidal segment of the tile 50*a*, and all other tiles to the left side of FIG. 4, extends from the lower left side of the tile to the upper right side of the tile, with the first arcuate element 52*a* extending from the upper edge to the left edge and the third arcuate element 56*a* extending from the lower edge to the right edge of the tile 50*a*.

The tiles on the right side of FIG. 4, e. g., tile 50*b*, also include a first or left hand arcuate segment, designated as 52*b*, a second central sinusoidal segment designated as 54*b*, and a third or right hand arcuate segment designated as 56*b*. However, the central sinusoidal areas 54*b* of the tiles 50*b* of the right side of FIG. 4, are mirror images of their counterparts of the tiles 50*a* of the left side of FIG. 4, extending from the lower right edge to the upper left edge in each of the tiles 50*b* of the right side of FIG. 4. The first arcuate area 52*b* of the tile 50*b* extends from the left side to the lower side of the tile 50*b*, while the third arcuate area 56*b* extends from the right side to the upper side of the tile 50*b*. Thus, the tiles of the right side of FIG. 4, e.g., tile 50*b*, are mirror images of the tiles to the left side of FIG. 4, e. g., tile 50*a*.

The total number of possible different tiles of each side of FIG. 4 may be calculated just as the number of full tiles in FIG. 1 was calculated. It will be noted that each of the tiles in the first column on the left side of FIG. 4, i. e., tile 50*a* and below, each have the same relative overlying and underlying relationship between the two arcuate segments and the central sinusoidal segment, with the arcuate segments each overlying a portion of the arcuate segment. With three different segments, and two different colors, textures, shades, or patterns depicted, the total number of different possibilities for this overlying and underlying segment configuration is $2^2$, or eight different tiles.

The next row to the right of the far left column of FIG. 4 shows the third or right hand arcuate segment area underlying the right side of the central sinusoidal element, with colors, shades, etc. corresponding to those adjacent tiles of the first column, again providing eight different combinations. The third column of the left side of FIG. 4 show the first arcuate segment area underlying the left side of the central sinusoidal area and the right arcuate segment overlying the right side of the sinusoidal area, while the fourth column shows the central sinusoidal area overlying portions of both the left and right arcuate segment areas. These four different overlying and underlying relationships, multiplied by the eight different color or shading combinations of each column, result in thirty two different tile configurations for the tiles of the left side of FIG. 2.

However, the mirror image disposition of the sinusoidal and arcuate elements in the tiles 50*b* relative to tiles 50*a* doubles the number of possible variations. The rows and columns of the right side of FIG. 4 will be seen to be equivalent to those of the left side of FIG. 4, but with the arcuate and sinusoidal elements being mirror images to those equivalent tiles of the opposite side of the Figure. Tiles 50*a* and 50*b* are exemplary to show this mirror image relationship. Thus, the thirty two different tiles of the left side of FIG. 4, with the thirty two mirror image tiles of the right side of FIG. 4, result in a total of sixty four different "full" tiles, or tiles having at least one arcuate or sinusoidal element end terminating at each of their four edges.

FIG. 5 illustrates all of the possible variations for second group border or peripheral tiles for the first group "full" tiles of FIG. 4. The second group tiles are formed of one or two of the elements of the full tiles of FIG. 4, but are missing at least one of those arcuate or sinusoidal elements. The second group tiles of FIG. 5 are divided into an upper and a lower set, with each set being a mirror image of the other, in the same manner as the left and right mirror image sets of the tiles of FIG. 4.

The tiles of the far right column 58 of FIG. 5 will be seen to each include a left hand arcuate element and an opposite right hand arcuate element, but are missing the central sinusoidal segment area contained in all of the tiles of FIG. 4. The four different color, shade, etc. combinations, with the mirror image configuration of the upper four tiles relative to the lower four tiles, results in a total of eight different tile combinations for the right hand column 58 of FIG. 5.

Each of the tiles of the right central column 60 will be seen to contain a central sinusoidal element, in combination with one arcuate element. The upper four tiles of this column 60 each have a left hand arcuate element overlapping a portion of the central sinusoidal element, while the lower four tiles of the column 60 each have a right hand arcuate element underlying a portion of the sinusoidal element. Different color, shading, or texture variations between the two elements in each of these tiles, result in a total of eight different tile configurations.

The left central column 62 of FIG. 5 contains additional tiles each containing only a single arcuate element in combination with the central sinusoidal element. The tiles of the column 62 are related to the tiles of the adjacent column 60 to the right, but it will be seen that the overlapping or underlying of the arcuate segment and central sinusoidal segment or element, is reversed in each horizontally adjacent tile in these two columns 60 and 62.

Finally, the far left column 64 of FIG. 5 contains all remaining tile variations, each including a single sinusoidal or arcuate element therein. A total of eight different tiles are shown in column 64 of FIG. 5; it will be seen that these tiles comprise all possible variations, as further single element tiles would be duplicates of those shown in the left column 64.

The thirty two different second group tiles of FIG. 5, along with the sixty four first group tiles of FIG. 4, result in a total of ninety six different tiles for the tile embodiment of FIGS. 4 and 5, where only two different colors, shades, or patterns of each of the segment areas are provided. As in the case of the tiles of FIGS. 1 through 3, further differentiation between segment areas by means of additional colors, etc., will result in many more tile variations which may be used to form patterns, or used in the play of a tile game somewhat like the game of FIG. 3. For example, if three different colors, etc. are used to differentiate the segment elements from one another, then 216 "full" tiles and 70 "border" tiles, totaling 286 tiles, may be formed. (The number is not an even multiple of the 96 tiles of FIGS. 4 and 5, due to the elimination of duplicate tiles in such a three color element set.) The use of four colors, shades, etc. would result in eight times the original 64 "full" tiles of FIG. 4, or a total of 512 "full" four color tiles, etc.

As noted above, the tile set of FIGS. 4 and 5 may be used to play a game, with an exemplary game pattern or layout being shown in FIG. 6. The object of the tile game of FIG. 6 is to form as many areas enclosed by an arcuate or sinusoidal loop, and/or as large such an area or areas, as possible. As in the case of the game of the tiles of FIGS. 1 through 3 discussed further above, the tiles are randomly distributed to opposing players or teams, according to the number of differently colored or shaded segments of the tiles (e. g., two different colors=two players/teams, etc.)

A first team or player initially places one of the "full" tiles shown in FIG. 4, i. e., a tile containing all three of the arcuate and sinusoidal segment area elements with at least one of those elements terminating at each of the four sides of the tile, on a suitable playing surface (table top, desk, etc). Again, it should be noted that none of the game variations which may be played using any of the tiles of the present invention, require any form of game board. Only a reasonably flat and level surface is required for the placement of the tiles, with further placement of subsequent tiles being "free form," and entirely dependent upon the imagination, skill, and strategy of each of the players or teams.

In the example of FIG. 6, the tiles have been used to form a first plurality of complete, closed arcuate loops of the first player or team (indicated by the vertically oriented shading lines of each of the loops) and a second plurality of closed loops of the second player or team (indicated by cross hatched shading lines in each of the completed loops). Two different first player or team continuous paths forming closed loops have been formed, designated as loops 66*a* and 66*b* in FIG. 3, with another individual circle 66 having also been formed. The opposing loops comprise two continuous paths forming closed loops, designated as loops 68*a* and 68*b*, with another two complete individual circles 68 also having been formed. (Incomplete loops or circles are not counted.) Scoring may be accomplished by counting the number of tiles used to form each closed loop, or the number of enclosed centers in each loop, or in some other agreed upon manner.

Figure 7:
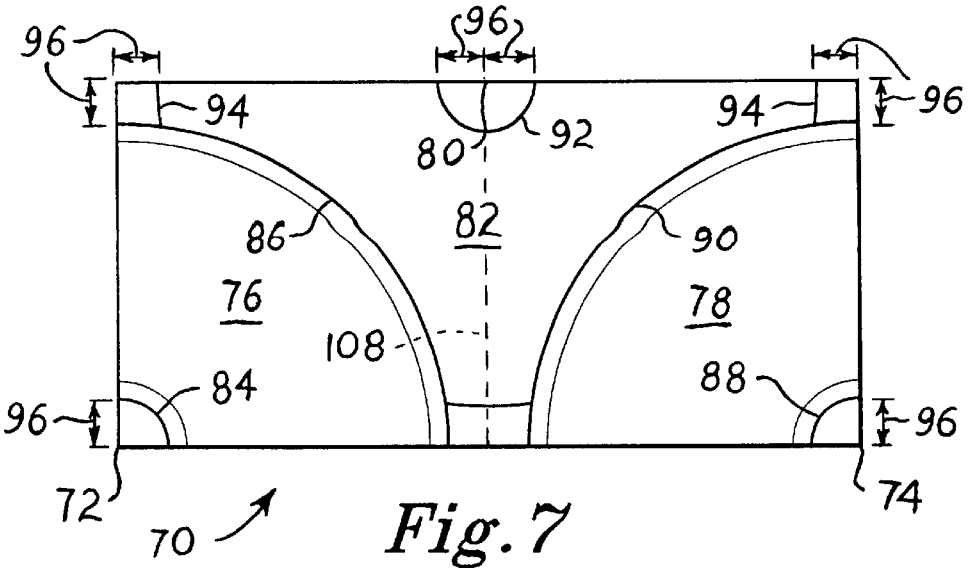
FIGS. 7 through 9 are plan views of alternative arcuate path configurations of the present tiles, illustrating different borders and edges for the arcuate segments thereon.
Figure 8:
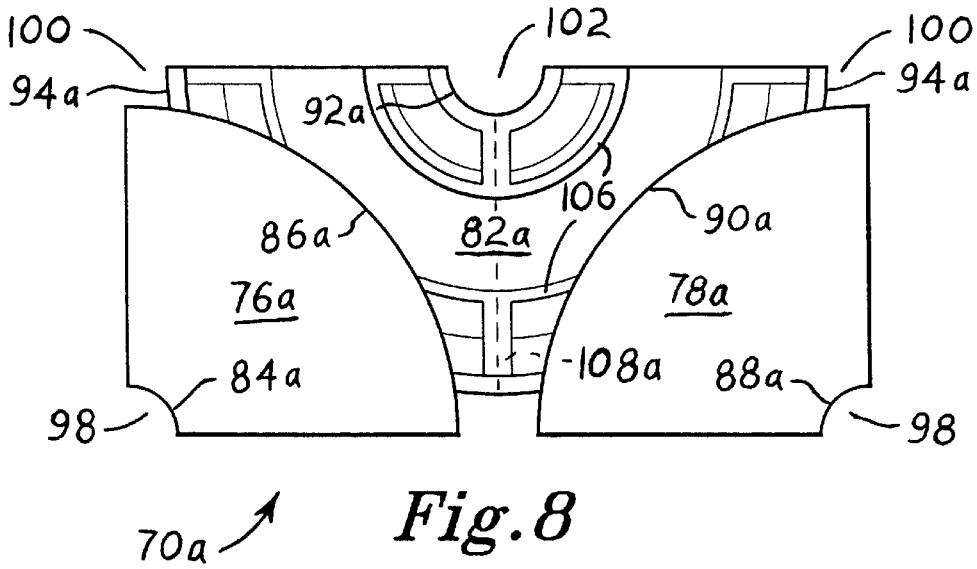
Figure 9:
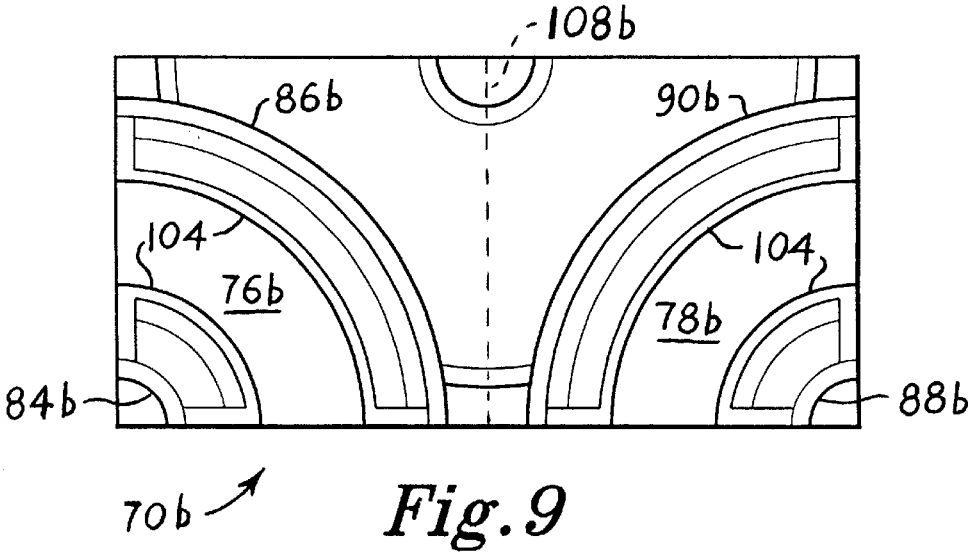

FIGS. 7 through 9 illustrate different patterns of arcuate and semicircular forms which may be used to form the tiles of FIG. 1. The tile 70 of FIG. 7 provides an exemplary model of the basic means used to form any or all of the tiles of FIGS. 1, 7, 8, and 9. All of the above tiles are formed by establishing the two opposed corners, e. Eg., corners 72 and 74, to form center points for the two quarter circular arcuate segments 76 and 78 at each side of the tile 70. The side opposite the two opposed center point corners 72 and 74 is bisected to establish a center point 80 for the semicircular arcuate segments 82, opposite the two quarter circular segments 76 and 78. In the case of the tile 70 of FIG. 7, the two opposed segments 76 and 78 each overlap a portion of the central semicircular arcuate segment 82, similar to the tiles 28*a* through 28*h* in the right hand column of FIG. 1, though the tile 70 is inverted relative to the tiles 28*a* through 28*h* of FIG. 1.

It is of course critical that the various arcuate segments of each of the tiles, e. g., segment areas 76, 78, and 82 of the tile 70 of FIG. 7, be symmetrically disposed along any edge at which they terminate. This is accomplished by spacing the first or inner and second or outer borders of each of the arcuate segments, an equal distance from each opposing corner of the tile. In the example of the tile 70 of FIG. 7, the first or inner border 84 and second or outer border 86 of the first segment 76, the first or inner border 88 and second or outer border 90 of the second segment 78, and first or inner border 92 and second or outer border 94 of the semicircular segment 82, are each positioned an equal distance 96 from their respective corners (or center point 80, in the case of the inner border 92 of the semicircular segment 82). This assures that each of the segments 76, 78, and 82 will meet precisely with any other segments of any other tiles which have been provided with the same spacing from the corners and center points for their respective segments, thereby providing a smooth and uninterrupted pattern or design when a plurality of the tiles are positioned with one another in an orderly manner, as in the game pattern of FIG. 3. It will be seen that this same principle of positioning each of the arcuate elements symmetrically along each terminating edge of a tile, is also applied to the tiles of FIGS. 4 through 6 which include sinusoidal segment elements therein, with each end of the sinusoidal element being centered between the center point of the longer side of the rectangular tile, and the corresponding corner.

FIG. 8 illustrates a variation on the tile 70 of FIG. 7. The tile 70*a* of FIG. 8 is formed in the same general manner as other tiles of the present invention, with a first arcuate segment area 76*a*, opposite second segment 78*a*, and semicircular segment area 82*a*. Each of the segments 76*a*, 78*a*, and 82*a* has an inner and an opposite outer border, respectively 84*a* and 86*a* for the first segment 76*a*; 88*a* and 90*a* for the second segment 78*a*; and 92*a* and 94*a* for the semicircular segment 82*a*. However, it will be noted that the lower corner areas 98 defined by the inner borders 84*a* and 88*a* respectively of the first and second arcuate segment areas 76*a* and 78*a*, upper corner areas 100 defined by the outer borders 86*a* and 90*a* of the first and second arcuate segment areas 76*a* and 78*a* and their intersection with the outer border 94*a* of the semicircular segment 82*a*, and upper center edge area 102 defined by the inner border 92*a* of the semicircular segment 82*a*, have been deleted from the tile 70*a*. Such a tile 70*a* still functions as an architectural or other structural article, and as a game tile in the manner of the tiles of FIGS. 1 through 3, as it is still essentially a rectangular shape, containing four sides. However, the tile 70*a* of FIG. 8 is reduced to its bare essentials by the elimination of the elements or background not contained within the inner and outer borders of the segments 76*a*, 78*a*, and 80*a*.

FIG. 9 discloses yet another variation upon the present tiles, designated as tile 70*b*. The tile 70*b* contains all of the elements of the tile 70 of FIG. 7 discussed further above, but also includes additional concentric elements 104 disposed within the inner borders 84*b*, 88*b* and outer borders 86*b*, 90*b* of the two opposed arcuate segments 76*b* and 78*b*. (The tile 70*a* of FIG. 8 contains similar concentric elements 106 adjacent the inner border 92*a* and outer border 94*a* of the semicircular segment area 82*a*.) These elements 104 and 106 provide greater interest to the eye and detail in architectural structures using the present tiles, and assist the eye in aligning the various tiles during the play of a game using such tiles. They may also provide further differentiation of different arcuate elements, to provide for a greater number of players and types of arcuate elements for a game.

It will be noted that broken lines, respectively 108 through 108*b*, have been placed vertically and medially across each of the respective tiles 70 through 70*b* of FIGS. 7 through 9. As each of the rectangular tiles 70 through 70*b* is twice as wide as it is high, the broken lines 108 through 108*b* result in dividing each of the respective tiles 70 through 70*b* into two square sections. The tiles 70 through 70*b* may be separated along their respective lines 108 through 108*b*, if desired, to form two separate square tiles as desired. It will be seen that such square tiles would each have two diagonally opposed quarter arcuate segments thereon, but this may vary depending upon the specific semicircular, arcuate, and/or sinusoidal patterns provided on each of the tiles.

It should also be noted that while rectangular tiles are illustrated in the preceding FIGS. 1 through 6 of the drawings, that it will be apparent to those skilled in the art of the present invention, that any of the tiles illustrated in those preceding Figures may be divided in a like manner as desired, to form square tiles. It should also be noted that the term "square" falls within the broader geometric shape of "rectangular" as each of the tiles has been previously described, as a square is nothing more than a special case of a rectangle, in which all of the four sides of the rectangle are equal in length to one another.

Figure 10:
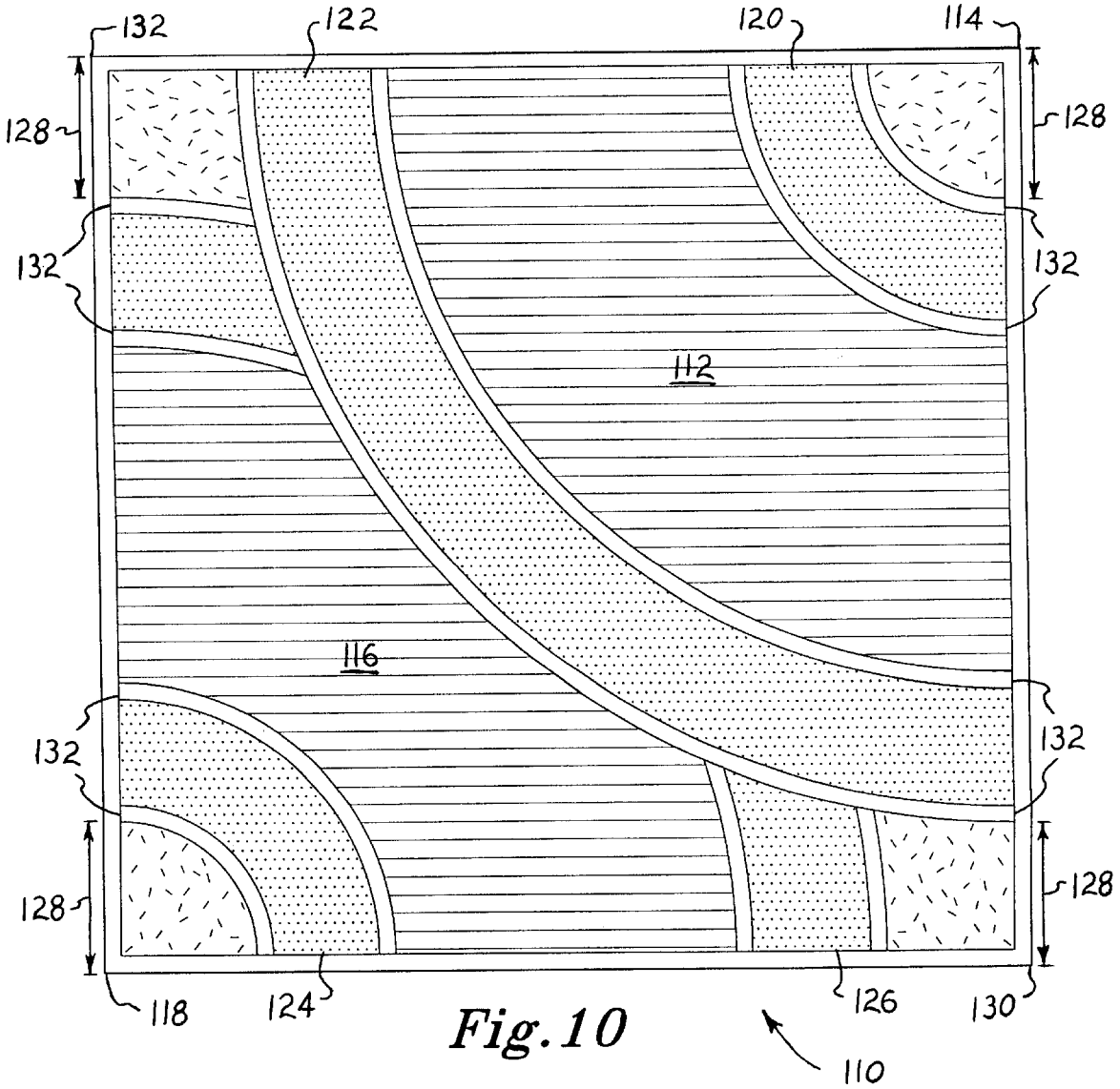
FIG. 10 is a plan view of an exemplary square tile of the present invention, showing its configuration.

FIG. 10 serves to clarify the above point, by showing an exemplary square tile 110 which may be used as a component in forming many of the various rectangular tiles of the present invention. The square tile 110 will be seen to be similar in configuration to half of one of the rectangular tiles 70 or 70*b* of FIGS. 7 and 9, having a first quarter circular segment 112 which is radially centered about a first corner 114, and an opposite second quarter circular segment 116 which is centered about a second corner 118, diagonally opposite the first corner 114. Each end of each segment 112 and 116 is symmetrically disposed along the respective edges at which they terminate, in the manner of other tiles discussed further above.

In the example of the tile 110 of FIG. 10, the first or inner border 120 and second or outer border 122 of the first segment 112, and the first or inner border 124 and second or outer border 126 of the second segment 116, are each positioned an equal distance 128 from their respective corners 114 and 130 (for the inner and outer borders 120 and 122 of the first segment 112) and corners 118 and 132 (for the inner and outer borders 124 and 126 of the second segment 116). It will be seen that these same distances 128 are subtended along the upper and lower edges of the square tile 110 of FIG. 10, but are not specifically indicated in the drawing Figure to avoid confusion. The above described configuration assures that each of the segments 112 and 116 will meet precisely with any other segments of any other tiles which have been provided with the same spacing 128 from the corners and center points for their respective segments, thereby providing a smooth and uninterrupted pattern or design when a plurality of such tiles 110 are positioned with one another in an orderly manner. It will be seen that this same principle of positioning each of the arcuate elements symmetrically along each terminating edge of a tile, is also applied to the tiles of FIGS. 4 through 6 which include sinusoidal segment elements therein, with each end of the sinusoidal element being centered between the center point of the longer side of the rectangular tile, and the corresponding corner, as described further above for the tile 70 of FIG. 7.

The relatively large view of the tile 110 of FIG. 10 also provides sufficient detail to show additional supplementary edging 132 along each border 120 through 126 of the segments 112 and 116. It will be seen that any number of borders, edging, etc. may be applied to the arcs of any of the tiles of the present invention, so long as all such borders, edging, etc., are symmetrically disposed about the center-point of each edge of the tile where the arcuate segment terminates, or in other words, so long as the distance from each opposite border, edging, etc. of a segment is the same to its corresponding corner.

It will be seen that the square tile 110 of FIG. 10 may be modified to provide any number of similar patterns, as desired. In the case of the tile 110 of FIG. 10, the first segment 112 to the upper right side of the tile, overlays a portion of the second segment 116 in the center of the tile 110. The overlying relationship of the two segments 112 and 116 is reversed by turning the tile 110 by one hundred eighty degrees, or inverting the tile. Also, it will be noted that the different colors, patterns, or shadings of the segments, borders, and background areas of the tile 110 may be varied as desired, to provide greater variety and interest.

In summary, the present tiles and games which may be played therewith, provide both a novel means of forming various architectural or other structural features, as well as numerous variations on games involving the formation of circular or arcuate shapes using the assembled tiles or playing pieces. It has been noted further above, that any of the rectangular tiles of FIGS. 1 through 9 may be further divided to form square shapes, if desired. Other variations are also possible, such as combining such square tiles to form cruciform structures having four arms radiating from a central tile, L-shaped assemblies having either equal or unequal length arms, etc. It will also be seen that a series of four rectangular tiles may be joined along adjacent elongate edges, with a single square tile joined to each end of the resulting square section tube, to form an enclosed rectangular solid shape. The same principle may be applied to a series of six square tiles, which may be joined together to form a cube. By assembling such structures with care, it will be seen that the circular or sinusoidal patterns of the tiles may be continued in an unbroken pattern about the entire solid structure. Accordingly, the present tile invention and games which may be played therewith, provide a novel means of creating various arcuate and sinusoidal patterns in either two or three dimensions for various purposes, limited only by the imagination of the user.

It is to be understood that the present invention is not limited to the embodiments described above, but encompasses any and all embodiments within the scope of the following claims.

I claim:

1. A method of playing a geometrically patterned tile game, comprising the following steps:

(a) providing a plurality of a first group of rectangular tiles, with each of the tiles of the first group having at least two different overlapping arcuate segments formed thereon, with each of the segments having a first end and an opposite second end extending to at least one edge of the corresponding tile so that each of the edges of each of the tiles has at least one segment end extending thereto, and with the arcuate segments forming a different pattern on each of the tiles;

(b) providing a plurality of a second group of rectangular tiles, with each of the tiles of the second group having at least one arcuate segment formed thereon corresponding to one of the arcuate segments of the first group, with the at least one segment having a first end and an opposite second end extending to at least one edge of the corresponding tile so that at least two edges of each of the tiles have at least one segment end extending thereto, and with the at least one arcuate segment forming a different pattern on each of the tiles;

(c) randomly distributing the tiles of the first group and second group among a number of players comprising no more than the number of different overlapping segments disposed on each of the first group of tiles;

(d) alternatingly matching tiles of the first group adjacent one another, thereby forming at least one continuous arcuate path across adjacent tiles;

(e) attempting to form at least one closed arcuate loop by selectively placing the tiles adjacent one another and extending the at least one continuous arcuate path until all of the first group of tiles are used;

(f) adding tiles of the second group of tiles, forming a periphery about the first group of tiles; and (g) determining scores of the players according to the areas enclosed by any closed arcuate loops formed by the players during the course of the game, said step of determining scores including the steps of:

(a) counting the number of complete, contiguous closed arcuate loops in different groups formed by each of the players;

(b) squaring the number counted for each of the groups;

(c) adding the squared numbers for determining a total score for each of the players.

2. The method of playing a geometrically patterned tile game according to claim 1, including the step of providing square tiles for at least some of the tiles of the second group.

3. The method of playing a geometrically patterned tile game according to claim 1, including the step of providing three different overlapping arcuate segments on at least some of the tiles of the first group.

4. The method of playing a geometrically patterned tile game according to claim 1, including the steps of:

(a) differentiating each of the segments from one another by different colors; and (b) coloring each of the tiles with a background color which is different from the different colors of the segments.

5. The method of playing a geometrically patterned tile game according to claim 1, including the steps of:

(a) providing a background for each of the tiles;

(b) providing means for differentiating each of the segments and the background from one another; and (c) selecting the differentiating means from the group consisting of different colors, different patterns, different textures, different shading, and different concentric borders.

6. The method of playing a geometrically patterned tile game according to claim 1, including the step of:

(a) forming at least one pattern on at least some of the tiles; and (b) selecting the at least one pattern from the group consisting of semicircular patterns and sinusoidal patterns.

7. The method of playing a geometrically patterned tile game according to claim 1, including the step of providing a total of fifty eight tiles including twenty four border tiles.

8. The method of playing a geometrically patterned tile game according to claim 1, including the step of providing a total of ninety six tiles including thirty two border tiles.

9. A plurality of geometrically patterned tiles, comprising:

a first group of rectangular tiles, each having an upper edge, a lower edge, side edges, a pair of upper corners and a pair of lower corners, each said upper edge and said lower edge having a length twice that of each of the side edges;

each of the tiles of said first group having two first quarter circular segments and a first semicircular segment formed thereon to define an overlapping arrangement, wherein said first quarter circular segments and said first semicircular segment form a different pattern on each of the tiles of said first group;

each of said first quarter circular segments having an inner border radially centered about a respective one of the upper corners and a outer border extending from a respective one of the side edges to the upper edge of each of the tiles of said first group;

said first semicircular segment having an inner border radially centered about a midpoint of the lower edge and an outer border extending from proximate one of the lower corners to proximate the other of the lower corners along the lower edge of the tiles of said first group;

a second group of rectangular tiles, each having an upper edge, a lower edge, side edges, a pair of upper corners and a pair of lower corners, each said upper edge and said lower edge having a length twice that of each of the side edges;

each of said tiles of said second group having at least one arcuate segment formed thereon, wherein said at least one arcuate segment forms a different pattern on each of the tiles of the second group, said arcuate segment being selected from the group consisting of a second quarter circular segment and a second semicircular segment;

said second quarter circular segment having an inner border radially centered about one of the upper and lower corners and an outer border extending from one of the side edges to the upper or lower edge of the tiles of said second group;

said second semicircular segment having an inner border radially centered about a midpoint of one of the upper and lower edges and an outer border extending from proximate one of the upper and lower corners to proximate the other of a respective one of the upper and lower corners along a respective one of the upper and lower edges of the tiles of the second group;

each said inner and outer border of each of said first quarter circular segments and said second quarter circular segment being positioned an equal distance from their respective corners;

whereby the tiles of said second group when assembled in matching relationship with the tiles of the first group form continuous arcuate designs.

10. The geometrically patterned tiles according to claim 9, wherein said first group of tiles include:

tiles having said first semicircular segment overlapping said two first quarter circular segments;

tiles having said two first quarter circular segments overlapping said first semicircular segment; and tiles having one of said first quarter circular segments overlapping said first semicircular segment with the other of said first quarter circular segments underlying said semicircular segment.

11. The geometrically patterned tiles according to claim 9, wherein the overlapping arrangement of said first quarter circular segments and said first semicircular segment defines a background on each of the tiles of said first group.

12. The geometrically patterned tiles according to claim 9, wherein said second group of tiles include:

tiles having said second semicircular segment formed thereon;

tiles having said second quarter circular segment formed thereon;

tiles having two said quarter circular segments formed thereon; and tiles having said second quarter circular segment and said second semicircular segment formed thereon to define an overlapping arrangement.

13. The geometrically patterned tiles according to claim 9, wherein said first group consists of 32 tiles and said second group consists of 26 tiles to provide a total of 58 different tile configurations.

14. A plurality of geometrically patterned tiles, comprising:

a first group of square tiles, each having at least a first corner and a second corner diagonally opposite the first corner;

each of said tiles of said first group having formed thereon a first quarter circular segment radially centered about the first corner and a second quarter circular segment radially centered about the second corner to define an overlapping arrangement, wherein said first quarter circular segment and said second quarter circular segment form a different pattern on each of the tiles of said first group;

a second group of square tiles, each having four corners;

said second group including tiles having formed thereon at least a quarter circular segment radially centered about one of the corners to form a different pattern on each of the tiles of the second group;

each said first, second and at least one quarter circular segments includes an inner border and an outer border, each said border being positioned an equal distance from their respective corners;

whereby the tiles of said second group when assembled in matching relationship with the tiles of the first group form continuous arcuate designs.

15. The geometrically patterned tiles according to claim 14, wherein said second group includes tiles having formed thereon two quarter circular segments radially centered about diagonally opposite corners to define an overlapping arrangement.

16. The geometrically patterned tiles according to claim 15, wherein each said two quarter circular segments includes an inner border and an outer border respectively positioned at a distance equal to the distance between each said inner and outer border of said first, second and at least one quarter circular segments and their respective corners.

17. The geometrically patterned tiles according to claim 14, wherein the overlapping arrangement of said first quarter circular segment and said second quarter circular segment defines a background on each of the tiles of said first group.

* * * * *